United States Patent [19]

Lozier

[11] 4,332,230

[45] Jun. 1, 1982

[54] DYNAMIC ACTION HIGH POWER SLINGSHOT

[76] Inventor: Leroy P. Lozier, 1934 Highland Ave., Las Cruces, N. Mex. 88001

[21] Appl. No.: 146,432

[22] Filed: May 5, 1980

[51] Int. Cl.[3] ..... F41B 7/00

[52] U.S. Cl. ..... 124/20 R

[58] Field of Search ..... 124/20 R, 20 B, 41 R, 124/17, 16

[56] References Cited

U.S. PATENT DOCUMENTS 2,585,663 2/1952 Laubly ..... 124/20 R 3,618,585 11/1971 Allison ..... 124/41 R X

*Primary Examiner*—Richard C. Pinkham

*Assistant Examiner*—William R. Browne

*Attorney, Agent, or Firm*—Schwartz & Weinrieb

[57] ABSTRACT

A slingshot having a hand grip, and two laterally spaced, hollow yokes defining channels therewithin and supported by said hand grip. The yokes extend upwardly and rearwardly from the hand grip. Elastic band extend through the channels and a pouch is connected to the elastic band for imparting a forward thrust to a missile or projectile disposed therein after the pouch is pulled back and released by the user. The slingshot effectively eliminates the flying, and flapping of the elastic after projecting an object, e.g., a tone, with the slingshot.

11 Claims, 1 Drawing Figure

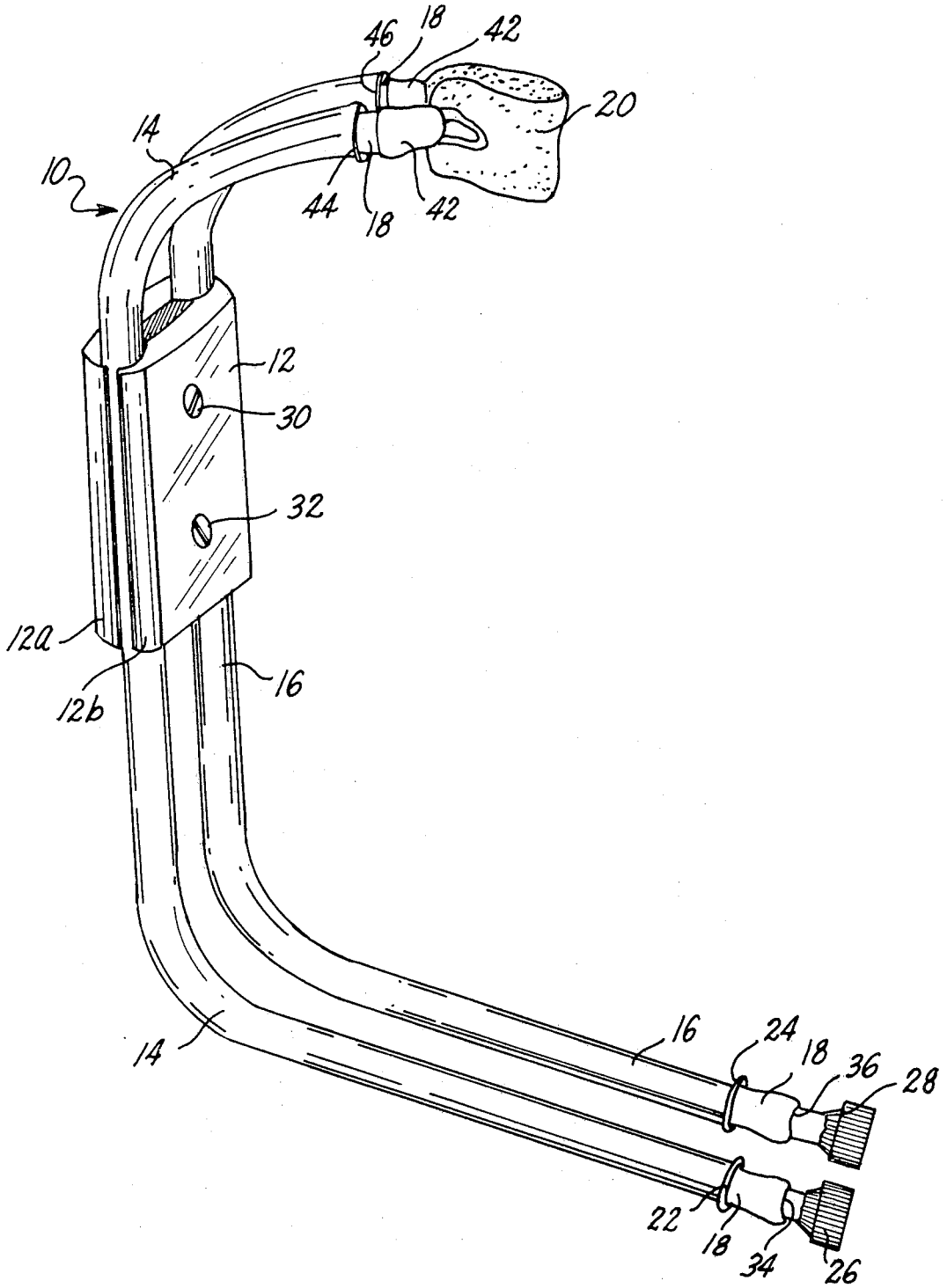
46
18
42
20
14
10
44
18
42
12
30
32
12a
12b
16
14
16
24
18
36
28
22
18
34
26

DYNAMIC ACTION HIGH POWER SLINGSHOT

BACKGROUND OF THE INVENTION

The present invention relates to improvements in projectile thrusting assemblies or slingshots, and more particularly, to projectile thrusting assemblies or slingshots having an elastic member wherein the flying and flapping of the elastic member is effectively prevented after the thrusting of an object. Similarly, a more accurate slingshot capable of imparting a greater thrust to a projectile is disclosed.

Numerous slingshots are disclosed in the prior art. For example, U.S. Pat. No. 2,585,663 discloses a single, hollow yoke having an elastic band passing therethrough and attached to a pouch for projecting a missile, e.g., a stone. Any user of the disclosed device would not be protected by the characteristic flying and flapping of the elastic member immediately following the projecting of a missile with this particular slingshot, and therefore be subjected to the possible snapping of the band against the user's hands. Another slingshot exhibiting a similar problem is disclosed in U.S. Pat. No. 3,494,346.

A need therefore exits for a slingshot having an elastic member that is capable of projecting a missile without causing injury to the user, due to the flying and flapping of the elastic member immediately following the projection of a missile therefrom. A need also exists for a slingshot that enables the user of the slingshot to shoot safely and accurately with from two to three times the power of a conventional slingshot and with improved accuracy.

OBJECTS OF THE INVENTION

It is therefore a significant object of the present invention to provide a slingshot that will enable the user to shoot safely with a greater power and with improved accuracy.

A further object of the present invention is the provision of a slingshot that effectively eliminates the flying and flapping of elastic thrust bands that are encountered with conventional slingshots and therefore, of significantly less danger to the user.

Still another object of the present invention is the provision of a slingshot that will be simple and economical to manufacture and will be long-lasting and dependable for the user.

Another object of this invention is to provide a slingshot wherein the elastic thrust bands are adjustable as to length in order to compensate for differences in the stretch limits of elastic thrust bands and to prolong the use of a particular elastic thrust band.

These and other objects of the present invention will become more apparent when consideration is given to the following description of the present invention.

BRIEF SUMMARY OF THE INVENTION

The present invention relates to a slingshot comprising: (a) a hand grip means; (b) two laterally spaced, hollow yokes defining channels therewithin and supported by the hand grip means, said yokes extending upwardly and rearwardly from the hand grip means; (c) elastic means extending through the channels; and (d) pouch means connected to the band means.

The present invention also relates to a slingshot comprising a hand grip means in combination with two separate, laterally spaced, hollow yokes supported by the handgrip means and defining channels therethrough with an elastic band means capable of being adjusted as to its length and extending through the channels and means for adjustable securing each end of the elastic means to the terminal end portion of each yoke.

BRIEF DESCRIPTION OF THE DRAWING

Additional advantages of the present invention will become apparent from the following detailed description and annexed drawing, wherein:

The sole FIGURE is a perspective view of the preferred slingshot of the present invention with the elastic means in a "rest" position.

DETAILED DESCRIPTION OF THE INVENTION

Referring now to the FIGURE, a slingshot, identified generally as element 10, is illustrated in the "rest" position and comprises a hand grip means 12 in combination with two laterally spaced, hollow yokes or tubular elements 14 and 16, defining channels therewithin. Yokes 14 and 16 extend upwardly and rearwardly from the hand grip means 12. Elastic means 18 extends through the channels defined by yokes 14 and 16 with pouch means 20 connected to the elastic means 18 for cradling projectiles to be hurled from the slingshot.

In order to optimize the forward thrust imparted to a missile or object placed in pouch means 20, slingshot 10 further comprises hollow yokes 14 and 16 extending downwardly and inwardly from the hand grip means 12. Elastic means 18 is adjustable secured to the terminal end portions 22 and 24 of each yoke 14 and 16, respectively, by adjusting means or plugs 26 and 28, respectively.

Yokes 14 and 16 are disposed in a parallel relationship such that yokes 14 and 16 are equidistant from each other and define an open, unobstructed area therebetween. Yokes 14 and 16 are generally C-shaped and each yoke defines a continuous and smoothly curved channel from one end to the other end, or terminal ends 22 and 24, without presenting any abrupt or sharp bends or turns therein.

Yokes 14 and 16 may be fabricated from various rigid, synthetic plastic materials, e.g., polyvinyl chloride, or from metal, or other suitable rigid materials.

Hand grip means 12 is preferably formed as a pistol grip type adapted for easy and firm holding of the slingshot. Preferably the upstanding grip means is formed from plastic, e.g., polyvinyl chloride, in two sections **12*a* and 12*b*, and are held together, for example, by bolts 30 and 32 and nuts (not shown). It is understood that hand grip means 12** can similarly be made of metal or other rigid hard materials.

Elastic means 18 is preferably a one-piece elastic band. Elastic means 18, as previously discussed, extends through the entirety of each channel defined by yokes 14 and 16 such that the remote or terminal end portions 34 and 36 of said elastic means 18 is secured at the terminal ends 34 and 36 of yokes 14 and 16. Elastic means 18 can be in the form of an elastic band, as noted, or surgical tubing or any other suitable elastic material. It is also understood that two separate elastic means can be used in the practice of the present invention provided that the two elastic means, e.g., two elastic bands, exhibit the same elasticity when subjected to the same stretch. When two elastic band means are employed, each band is disposed within a separate yoke with one terminal end portion of each band secured to the terminal end portion 34 and 36 of yokes 14 and 16, respectively, and the other end of each band being secured or otherwise attached by conventional means, to pouch means 20.

Best projection results are achieved when a single elastic band means is employed in the practice of the invention. In this case, it is most important to position pouch means 20 so that substantially equal tension is imparted to each section of the elastic band means extending from the pouch means 20 to the terminal end portions of the yokes. Further, the structure of elastic band means 20 is such to permit a user to place a missile or object in pouch means 20 and pull back on said pouch means 20 by stretching the elastic means and thus, achieve the desired tensioning in the elastic means, while, at the same time, preventing the stretch from exceeding the elastic limits of the elastic means. As is well known to one of ordinary skill in the art, when the elastic means is released by the user, the missile or object will be projected in the desired direction and the elastic means will return to its normal rest condition.

Should the elastic means be stretched beyond the elastic limits of the elastic means, such elastic means will generally not resume its original length, but rather, assume a somewhat longer length. In addition, continued use of the elastic means, within its normal elasticity range, will also generally cause the elastic means to lose some of its elasticity resulting in the elastic means becoming somewhat longer in length and thereby necessitating the user to pull on the pouch means over a greater distance before the elastic means comes close to its elastic limit so that the user can impart the desired thrust to a projectile or missile.

In order to compensate for the reduced elasticity of the elastic means, adjustable means 26 and 28 such as plugs, are provided for adjustably securing each end of elastic means 18 to each terminal end portion 34 and 36 of yokes 14 and 16, respectively.

When the elastic means 20 is pulled to impart a forward thrust to a missile or object, upon release thereof, the point of stretch begins at the lower end adjacent the terminal end portions 34 and 36 of the yokes and thereafter is subjected to a stretching action over its entire length before being released. Once the projectile is released from pouch means 20, elastic means 18 returns to a "rest" position within the yokes or tubular members 14 and 16 and thereby eliminates the flying and flapping elastic means that are generally encountered with conventional slingshots.

It is significant to note that the yokes used in the present invention are generally "C" shaped and do not provide any abrupt bends which would affect the life of the elastic means. With the continuous and smooth channels being provided by the yokes of the present invention, the elastic members are permitted to stretch uniformly over their entire length and thereby prevent any localized stretch conditions that could exceed the elastic limit of the elastic means to cause the elastic means to snap at any such abrupt bend zone.

Pouch means 20 may be fabricated of leather, vinyl or other suitable materials generally used for such pouches. The elastic means 18 may be secured to pouch means 20 in various ways. For example, the pouch can be formed with an end opening 40 located on each side of the pouch through which element 18 is passed. Preferably, that portion of elastic means 18 passing through pouch 20 is reinforced by a wrapping of suitable material, e.g., rubber tubing 42, or possibly, latex tape. The pouch means is generally located adjacent the upper end portions 44 and 46 of said yokes 14 and 16 when said elastic means 18 is in a rest position.

The present disclosure is directed to the preferred embodiments of the present invention, but, it will also be understood that various changes and modifications in addition to those discussed hereinbefore can be made without departing from the scope of the invention as defined in the appended claims. It is intended, therefore, that all matter contained in the foregoing description shall be interpreted as illustrative only and not as limitative of the invention.

What is claimed is:

1. A slingshot comprising:

(a) hand grip means for holding the slingshot;

(b) two separate and laterally spaced, hollow yokes, disposed so as to permit parallel planes to pass therethrough throughout their lengths and defining channels therewithin and supported by said hand grip means, each of said yokes extending upwardly and rearwardly, and downwardly from said hand grip means;

(c) elastic means for projecting a projectile, said elastic means extending through said channels;

(d) pouch means connected to the other end of said elastic means for receiving a projectile; and (e) said hand grip means being secured to said yokes and being disposed intermediate the ends of said yokes so as to provide said slingshot with a requisite high degree of balance and stability during a shooting operation of a projectile.

2. The slingshot of claim 1 wherein said yokes define an unobstructed, open area therebetween.

3. The slingshot of claim 2, wherein said hollow yokes are C-shaped yokes and define a continuous and smoothly curved channels from one end to another.

4. The slingshot of claim 3, wherein said grip means is upstanding.

5. The slingshot of claim 3, wherein each yoke has an upper end portion and a lower terminal end portion.

6. The slingshot of claim 5, wherein said elastic means is an elastic band and said slingshot further comprises means for adjustably securing said elastic band to each terminal end portion of said yokes.

7. The slingshot of claim 6, wherein said adjustable means is a plug.

8. A slingshot comprising:

(a) hand grip means for holding the slingshot;

(b) two separate, and laterally spaced hollow yokes disposed so as to permit parallel planes to pass therethrough throughout their lengths and defining channels therewithin and supported by said hand grip means, each said yokes extending upwardly and rearwardly, downwardly and being supported by said hand grip means and defining channels therethrough;

(c) an adjustable elastic means for projecting a projectile, each said elastic means extending through one of said channels;

(d) means for adjustably securing said elastic means to the terminal end portion of each of said yokes; and (e) pouch means for receiving a projectile connected to said elastic means, (f) said hand grip means being secured to said yokes and being disposed intermediate the ends of said yokes so as to provide said slingshot with a requisite high degree of balance and stability during a shooting operation of a projectile.

9. The slingshot of claim 8, wherein said elastic means is rubber tubing.

10. The slingshot of claim 9, wherein said pouch means is adjacent the upper end portion of each of said yokes when said elastic means is in the rest position.

11. The slingshot of claim 10 wherein said hand grip means is upstanding and said yokes are parallel to each other.

* * * * *